US005092038A

United States Patent [19]

Geppelt et al.

[11] Patent Number: 5,092,038

[45] Date of Patent: Mar. 3, 1992

[54] METHOD OF MANUFACTURING SPIRAL HEAT EXCHANGER TUBES WITH AN EXTERNAL FIN

[75] Inventors: Elmo W. Geppelt; William H. Poore, both of Tulsa, Okla.

[73] Assignee: G. P. Industries, Inc., Tulsa, Okla.

[21] Appl. No.: 616,321

[22] Filed: Nov. 21, 1990

Related U.S. Application Data

[62] Division of Ser. No. 332,794, Apr. 3, 1989, abandoned.

[51] Int. Cl.[5] ..... B23P 15/26

[52] U.S. Cl. ..... 29/890.048; 72/371

[58] Field of Search ..... 29/890.048, 424, 890.049, 29/890.053; 138/38; 72/292, 299, 371

[56] References Cited

U.S. PATENT DOCUMENTS

| | | | |
|---|---|---|---|
| 1,983,468 | 12/1934 | Knab | 72/292 |
| 3,533,267 | 10/1970 | Bunnell | 72/299 |
| 4,059,004 | 11/1977 | Perkins | 72/299 |
| 4,171,634 | 10/1979 | Perkins | 72/299 |
| 4,203,312 | 5/1980 | Perkins | 72/299 |
| 4,236,299 | 12/1980 | Joekel et al. | 29/890.048 |
| 4,317,353 | 3/1982 | Geppelt | 72/299 |
| 4,514,900 | 5/1985 | Bénard | 29/890.048 |
| 4,735,071 | 4/1988 | Ueda et al. | 29/890.048 |

FOREIGN PATENT DOCUMENTS

| | | | |
|---|---|---|---|
| 2136985 | 10/1980 | Fed. Rep. of Germany | 72/299 |

*Primary Examiner*—Irene Cuda
*Attorney, Agent, or Firm*—Head and Johnson

[57] ABSTRACT

An improved heat exchanger tube is provided in which the tube has one or more paralleled integral spirals formed in the tube wall providing on the exterior surface one or more convoluted spiral recesses of selected pitch, and fin members affixed to the spiral tube providing a tube having greatly increased external surface area, per unit of length and a convoluted, laminar flow breaking, interior surface.

6 Claims, 7 Drawing Sheets

METHOD OF MANUFACTURING SPIRAL HEAT EXCHANGER TUBES WITH AN EXTERNAL FIN

This is a divisional of copending application Ser. No. 07/332,794 filed on 04/03/89, now abandoned.

SUMMARY OF THE INVENTION

Heat exchange tubes are utilized in the manufacture of heat exchangers for a great variety of purposes. Heat exchange tubes are commonly employed such as for exchanging heat between a liquid and a gas, wherein the gas is usually the atmosphere, or between one liquid and another. Heat exchange takes place by flowing one fluid, such as a liquid, in the interior of the heat exchange tube and another fluid, which may be a gas, such as the atmosphere, exteriorly of the tube. Heat exchange can be accomplished wherein the tube is merely a straight cylindrical walled tube. However, it can easily be understood that in order to increase the rate of heat exchange, more heat is passed between the fluid inside the tube and that externally of the tube if the surface area of the tube is increased. This is frequently accomplished by the use of fins affixed to the exterior of the tube.

In addition, it can be seen that the rate of heat exchange can be increased even more by not only increasing the surface area of the tube; but also by increasing the turbulence of the fluid flow within the tube. In a straight cylindrical tube there is a tendency for laminar flow to develop in which the fluid flowing adjacent the wall of the tube is subject to heat exchange, but the fluid flowing in the stream interiorly of that which contacts the wall is insulated from heat exchange relationship with the tube. To break up laminar flow and to increase the contact of the fluid within the tube interior wall, a common expedient has been to provide convoluted tubes. This is typically achieved by twisting the tube to form integral spiral convolutes in the tube wall. For reference to a method of manufacturing spiral or twisted tube see U.S. Pat. No. 4,437,329.

The present disclosure is directed to a heat exchange tube having improved means of achieving heat transfer from a fluid in the tube with fluid externally of the tube. In the present invention, this is accomplished by taking advantage of the benefits of a spiralled tube and also by taking advantage of the benefits of fins affixed to the exterior of a tube. Thus, the present invention provides a spiral tube having an external fin extending from the tube external surface. In one embodiment, the external fin may be attached to the tube after a spiral has been integrally formed therein. In this case the fin can be affixed to the tube by positioning the fin in the spiralled recess formed on the external wall of the tube. In another embodiment of the invention, a fin is first affixed to the external surface of a cylindrical walled tube; and thereafter the tube is twisted to form integral convolutes therein in a manner so that the fin remains affixed to the wall of the tube, the fin preferably extending from a spiral recess formed in the tube exterior wall during the twisting process.

In a third embodiment of the invention, rolled threads of a machined spiralled groove are formed in the external cylindrical wall of a tube. The threads may be formed such as by rolling the tube against a rotating thread forming die or cutting a continuous groove on a lathe. Either of these steps provides a spiral integral thread or groove in the wall of the tube. Thereafter, the tube is twisted to provide integral convolutes in the tube in which the rolled thread or cut groove is super imposed on the convolutes providing a highly irregular twisted tube, providing increased surface area and increased turbidity of fluid flow through the tube for improved heat exchange.

In a fourth embodiment the tube has formed on the exterior surface closely spaced integral upstanding spines, usually in a spiral pattern, while the tube internal wall remains cylindrical. Thereafter, this spiney finned tube is twisted, forming convolutes in the tube wall. The twisted spiney finned tube therefore has a spiney, convoluted exterior surface greatly increasing the surface area per unit of length, and a convoluted interior surface which breaks up laminar fluid flow through the tube to enhance heat transfer.

For reference to prior issued patents which show heat exchange tubes, and particularly heat exchange tubes having externally affixed fins, see the following U.S. Pat. Nos. 1,246,583; 2,115,769; 2,525,945; 3,394,736; 3,578,075; 3,636,982; 3,777,343; 3,826,304; 4,248,179; 4,705,103.

A better understanding of the invention will be had by reference to the following description of the preferred embodiments and the claims taken in conjunction with the attached drawings.

DESCRIPTION OF THE DRAWINGS

FIG. 14 is essentially the same as FIG. 10, but showing the use of an L-shaped fin.

DESCRIPTION OF THE PREFERRED EMBODIMENTS

Heat exchange tubes are used in a great many different applications for exchanging the temperature of one fluid medium with another in which the fluids may be either liquids or gases. The most common type of heat exchange is wherein heat is exchanged between a liquid flowing within the interior of the tube and a gas, such as the atmosphere flowing externally of the tube; however, heat exchange tubes may be used in application wherein the exchange is between liquid and liquid or between gas and gas. In any event, a heat exchange tube provides a closed fluid flow passageway with opportunity for the transfer of heat. For this reason, heat exchange tubes are usually used in multiple arrangements—that is, a number of heat exchange tubes are employed in a package with a header at each end, however, in some application only a single heat exchange tube may be required.

Heat exchange takes place by heat migration through the wall of the tube. Heat migration is proportional to the difference in temperature of the interior and exterior surface of a tube wall. To achieve improved heat transfer, two techniques have been commonly employed. One is the use of fins affixed to the external surface of the tube. The fins are usually affixed in a spiral pattern onto the cylindrical wall of a tube. Another common expedient is the use of helical tubes; that is, wherein the tube is twisted to provide a helix therein. This type of helical heat exchange tube has the advantage of increased external and internal surface area for a given tube length; and, in addition, increases turbidity of the fluid flow internally and externally of the tube to thereby augment heat transfer. The present invention is directed to a type of heat transfer tube which takes advantage of both the fin tube and the spiralled tube; and provides a heat transfer tube which is both spiralled, that is, has integral convolutes formed in the tube wall, and in addition, has fins on the external surface.

Figure 1:
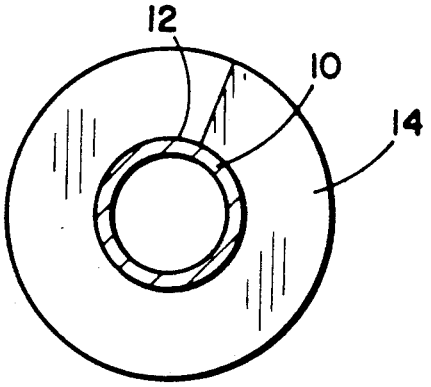
FIG. 1 is a cross-sectional view taken perpendicular of the length of a cylindrical tube showing an external fin formed on the external surface of the tube.
Figure 2:
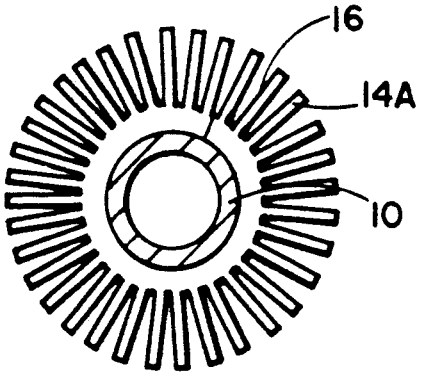
FIG. 2 is a cross-section view as in FIG. 1, but showing the arrangement wherein the external fin is serrated.

Referring to FIG. 1, a cross-sectional view is shown of a typical heat exchange tube having a fin secured to the external surface of the tube wall being indicated by the numeral 10, the tube exterior surface being indicated by numeral 12 and the fin by numeral 14. FIG. 2 is a cross-sectional view as in FIG. 1, but wherein the fin 14A is serrated; that is, provided with spaced slots 16. The use of a serrated fin 14A is advantageous wherein the height of the fin would make it difficult to wrap a fin on a tube since the outer portion of the fin must stretch and the inner portion compact to form an elongated strip into a fin around the exterior of a cylindrical tube.

Figure 3:
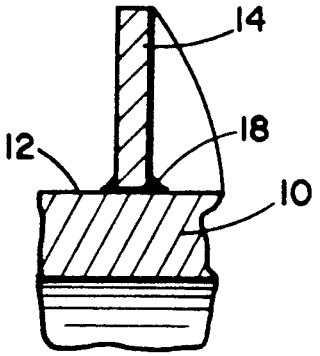
FIG. 3 is a fragmentary cross-sectional view of the wall of a cylindrical tube showing a fin affixed thereto, such as by welding.

FIG. 3 is a fragmentary cross-sectional view showing a tube wall 10 with a fin 14 secured to the tube exterior surface 12. In this Figure, the fin 14 is secured such as by welding 18.

Figure 4:
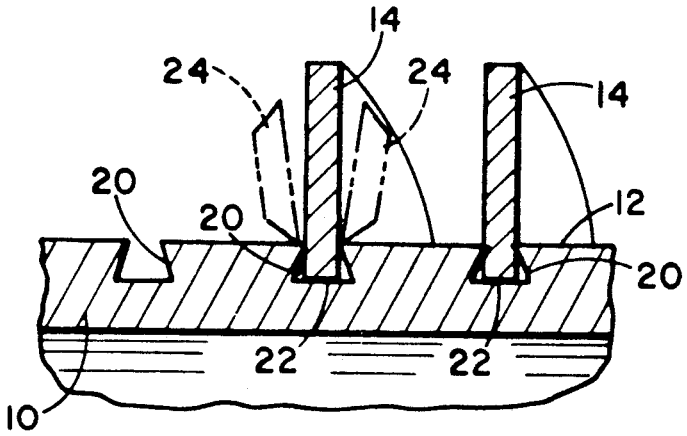
FIG. 4 is a fragmentary cross-sectional view of the wall of a cylindrical heat exchange tube in which dovetailed-shaped grooves are formed in the exterior surface of the cylindrical tube and the base edge of a fin is positioned in the groove and locked in the groove by crimping the edges of the groove.

FIG. 4 shows an alternate arrangement for securing a fin to a tube wall. In FIG. 4 the tube wall exterior wall surface 12 has a spaced apart spiralled groove 20 formed in the tube wall external surface. A fin 14 is spiralled onto the tube wall 10 so that base edge 22 is received within the groove 20. To secure the fin within the groove roller 24 can be used to crimp the portion of the tube wall 10 adjacent the spiral grooves 20 to deform the tube wall to engage the fins 14.

Figure 5:
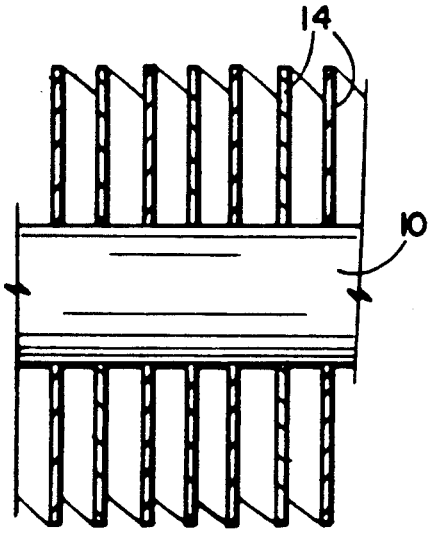
FIG. 5 is an external view of a cylindrical tube having a spiral fin formed thereon.

FIG. 5 shows fins mounted in spiral arrangement on the external surface of tube 10. The fins are mounted on the tube in preparation for forming helical convolutes in the tube, as will be described subsequently.

Figure 6:
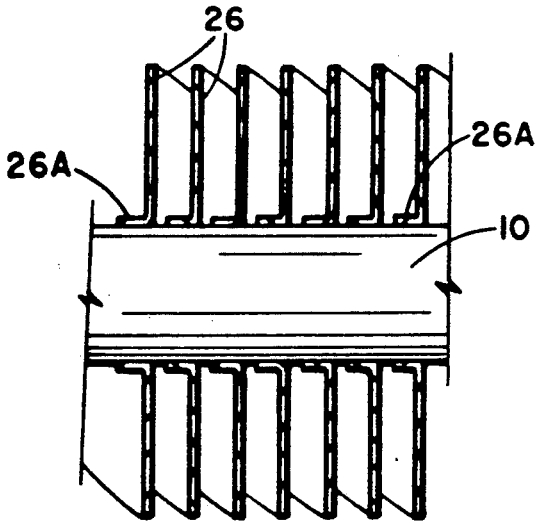
FIG. 6 is an alternate arrangement for affixing a spiral fin to a cylindrical tube in which the fin, in cross-section, is L-shaped, providing a foot which is affixed to the tube external wall.

FIG. 6 shows a different type of fin 26 which has a L-shaped foot portion 26A. The fins 26 are coiled on the external surface of the tube 10 and the increased area provided by the foot portions 26A provide means whereby the fins may be more securely welded or otherwise attached to the tube surface.

Figure 7:
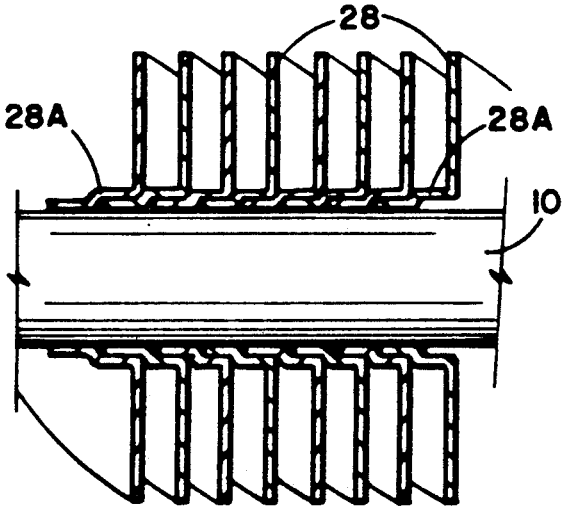
FIG. 7 shows an alternate embodiment of FIG. 6 in which the foot portion of the fin is overlapped as it is affixed to the external wall of a cylindrical heat exchange tube.

FIG. 7 shows a still different means of attaching fins to a tube 10. In this arrangement, the fins 28 are L-shaped, but with a longer foot portion 28A so that the foot portions overlap each other.

The FIGS. 1-7 illustrate various types of fins which are used on the surface of heat exchange tubes and which may be employed in the practice of this invention. The concept disclosed in FIGS. 1-7 may, in one sense, be referred to as prior art since these concepts are commonly employed on heat exchange tubes having fins. The present invention, however, is to utilize such known fin arrangements in the production of improved twisted or convoluted heat exchange tubes.

Figure 8:
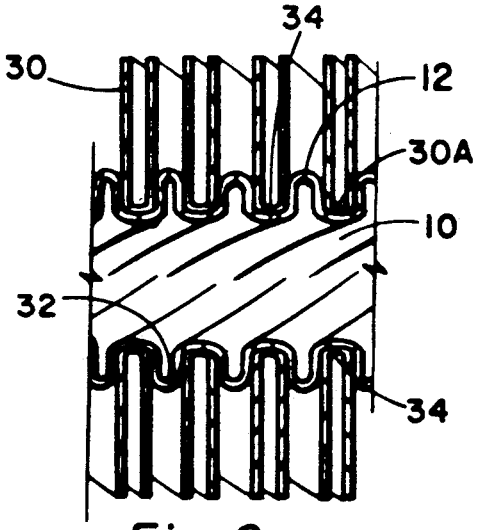
FIG. 8 is a cross-sectional view of a convoluted heat exchange tube showing external fins affixed to the tube, the fins being of U-shaped configuration and being received in the spiral recesses formed in the external wall of the tube.

FIG. 8 shows an embodiment of the present invention. In this embodiment, a tube 10 has mounted on the external surface 12 helically wound U-shaped fins 30. Each of the fins is elongated and in cross-section has a bite portion 30A. The bite portion 30A engages the external surface of the tube 10. Further, the tube 10 has been twisted as to form integral convolutes 32 with helical valleys or recesses 34 therebetween. These helical valleys 34 receive the U-shaped fin 31 on the external surface of the tube 10.

It can be seen that the embodiment of FIG. 8 provides a tube which has greatly increased heat exchange capability compared with the standard cylindrical tube which has not been twisted and which does not have external fins. The arrangement of FIG. 8 achieves greater heat transfer for a given length of tube by the greatly increased external surface area achieved by the fins 30. In addition, the surface area is increased by the twisting thereof which provides the integral convolutes 32 with the helical valleys therebetween. The heat exchange rate is also increased since the internal surface area of the tube for a given length is increased by the helical convolutes; and, further, the flow of fluid through the tube is subject to turbulence due to the convoluted internal surface which causes the fluid to have more intimate contact with the internal surface. This prevents laminar fluid flow paths within the tube, as can occur in a straight internal cylindrical wall tube.

Figure 10:
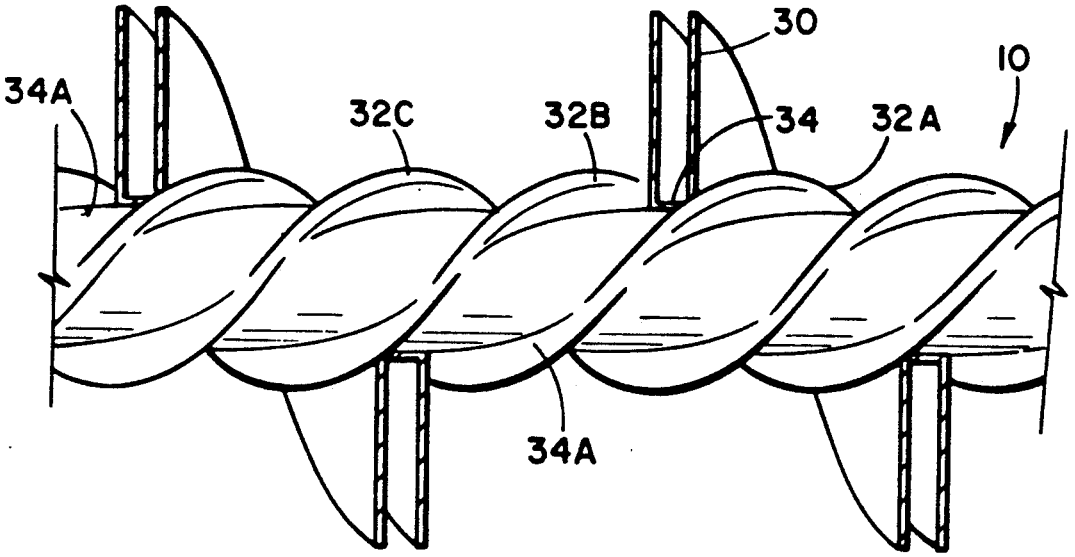
FIG. 10 is an external view of a twisted tube showing a spiral external fin formed on the tube external surface and in the recess of one of the grooves. The fin is of the U-shaped type.

FIG. 10 shows an embodiment of the invention wherein the tube 10 has been twisted to form three paralleled convolutes 32A, 32B and 32C. The convolutes extend for the length of the twisted portion of the tube. Received in the helical valley 34A between convolutes 32A and 32B is a U-shaped fin 30, of the type illustrated in FIG. 8. The fin 30 has bite portion 34 which engages the tube surface in the helical valley 34. With respect to FIG. 10, it can be seen that a fin could also be placed in the helical valleys existing between convolutes 32A and 32C and in the halical valley between convolutes 32B and 32C if desired. Whereas FIG. 8 shows a fin in each convolute, FIG. 10 shows that where a plurality of parallel convolutes are formed in a tube an external fin may be formed in only one, or can be formed in more than one or in all of the paralleled convolutes.

Figure 9:
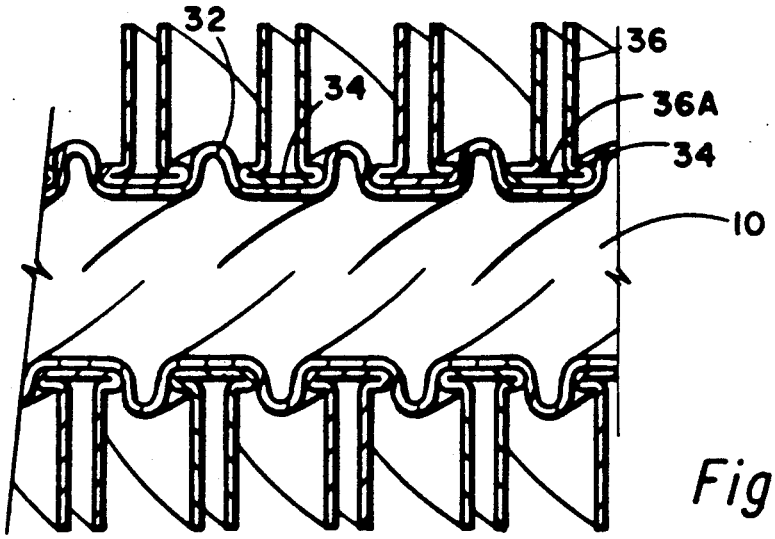
FIG. 9 is a cross-sectional view as in FIG. 8 showing an alternate embodiment in which the external fins are U-shaped and have broadened bases which are received in the external spiral recesses of the spiral tube.

FIG. 9 is an embodiment like FIG. 8 except the tube 10 has been twisted so that the integral convolutions 32 are narrow compared to the helical valleys 34 therebetween. These rather wide helical valleys 34 receive a unique type of fin tube 36 which is different from the U-shaped fin 30 of FIGS. 8 and 10 in that the bite portion 36A is spread out so that the base of the U-shaped tube is wider in cross-section than the width between the U-shaped fins 36. This arrangement provides for increased transfer between the convoluted tube and the fins 36.

Figure 12:
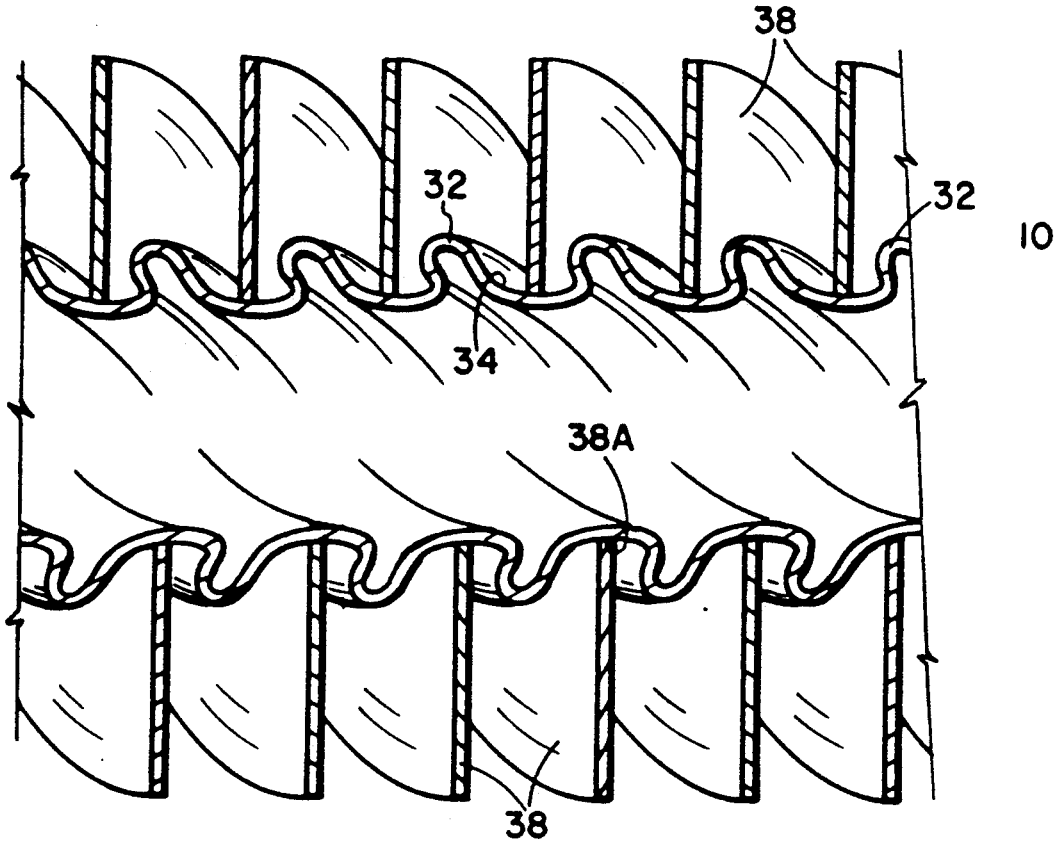
FIG. 12 is a cross-sectional view of a heat exchange tube of the type as shown in FIG. 11 after the tube has been twisted to form helical convolutes therein. The tube of FIG. 12 has five parallel helixes therein, one for each of the fins.
Figure 11:
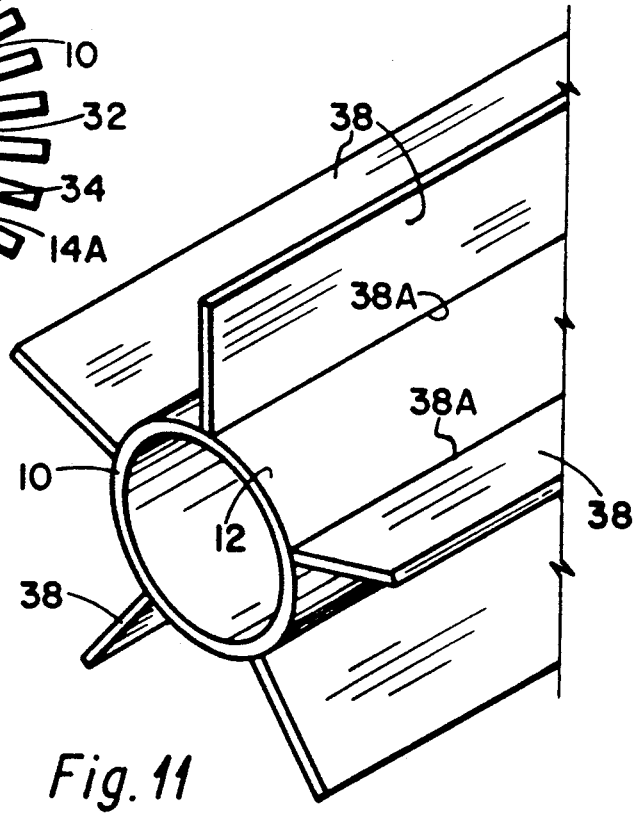
FIG. 11 is an isometric view showing the end of a cylindrical tube having radially extending fins secured to the external surface, the fins being in planes of the tube cylindrical axis and showing the tube after affixation of the fins, but before the tube is twisted to form convolutes therein.

Whereas FIGS. 1-7 show the placement of fins on a tube in a spiral format before the tube is subjected to twisting to form convolutes therein, FIG. 11 shows the fins placed in a different manner. In FIG. 11, the fins 38, five of which are employed, are affixed to the tube external wall 12 in planes of the tubular axis. The fins 38 may be affixed to the tube wall 12 such as by welding; that is, the base edge 38A of each of the fins 38 is welded or otherwise secured to the surface of tube 10. After the fins 38 have been attached, as illustrated in FIG. 11, the tube may then be twisted to form, as shown in cross-section in FIG. 12, a convoluted tube with the fin 38 extending therefrom. Note that in FIG. 12, the tube 10 has been twisted to form five paralleled spiraled convolutes 32; and, therefore, five paralleled helical valleys therebetween. Whereas FIGS. 11 and 12 show the placement of five fins 38 on the cylindrical surface of the tube; and, thereafter, twisting the tube to form five convolutes therein. It can be seen that one, two, three, four, or more fins may be spaced upon the external cylindrical surface of the tube in planes on the tube cylindrical axis; and, thereafter, the tube twisted with preferably the number of convolutes equaling the number of fins.

Thus, it is illustrated that in one embodiment of the invention, that is, where the fins are attached before the tube is twisted to form convolutes, the placement of fins on convolute tubes can be achieved in basically two ways. One is to attach the fins in helical convolute style on the cylindrical surface before the tube is twisted, such as suggested in FIGS. 1-7. The other is to attach the fins in planes of the tube's cylindrical axis before the tube is twisted, as suggested in FIGS. 11 and 12.

Figure 13:
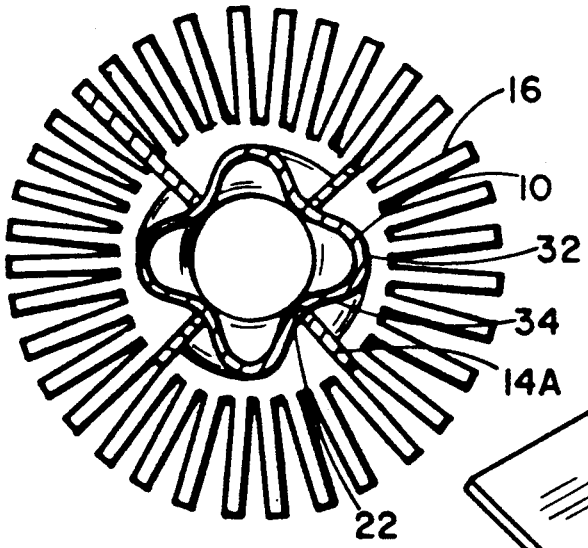
FIG. 13 is a cross-sectional view of a heat exchange tube which has four parallel helixes and each of the helixes has a fin received in the recess therein, the fins extending radially of the tube, and in which the fins are of the serrated type.

FIG. 13 is a cross-sectional view showing a serrated type fin, such shown in FIG. 2, on a twisted tube. In this view, there are four parallel integral convolutes 32 formed in the tube wall 10 with the base edge 22 of the fins 14A received in each helical valley 34. The use of serrated fins is advantageous in that it permits the fin outer edge area to expand much easier than when a solid fin is wrapped on a tube.

Figure 14:
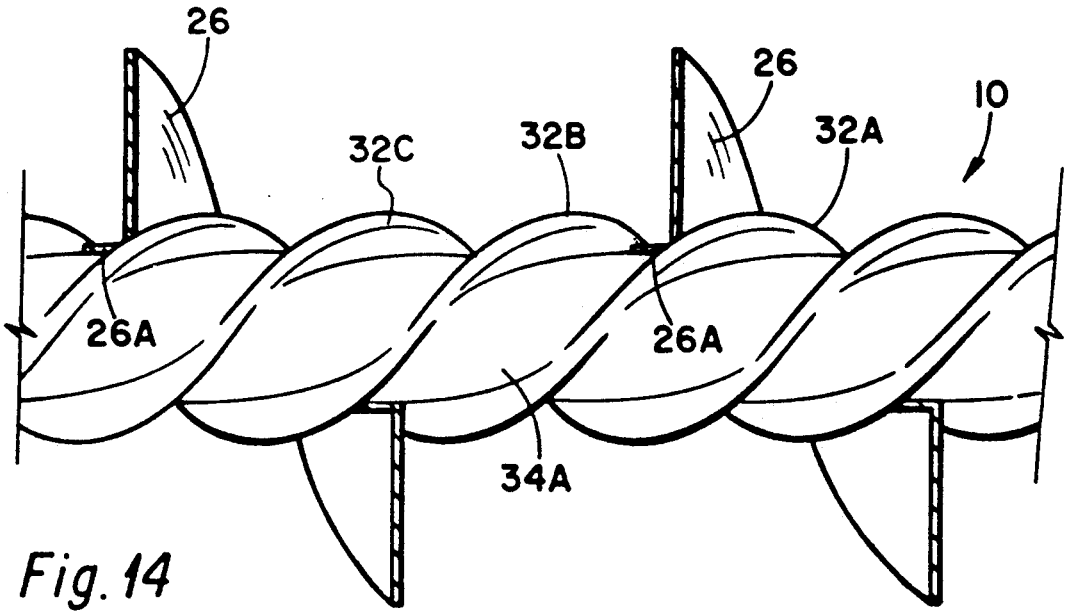
FIG. 14 is an external view of a twisted tube having three parallel helixes and in which a fin of a L-shaped type is secured to the surface of the tube in one of the helixes.

FIG. 14 is an external view of a twisted fin tube with a fin on the exterior surface with the fin being shown in cross-section. As in FIG. 3, the tube 10 of FIG. 14 has three parallel integral convolutes 32A, 32B and 32C with helical valleys in between. Received in one of the helical valleys 34A is a L-shaped fin 26 having a foot portion 26A, as previously described with reference to FIG. 6. The fin 26 is placed in only one of the three paralleled helical valleys formed in the surface of the tube, although it can be seen that the fin could be placed in the other two helical valleys if desired.

Figure 16:
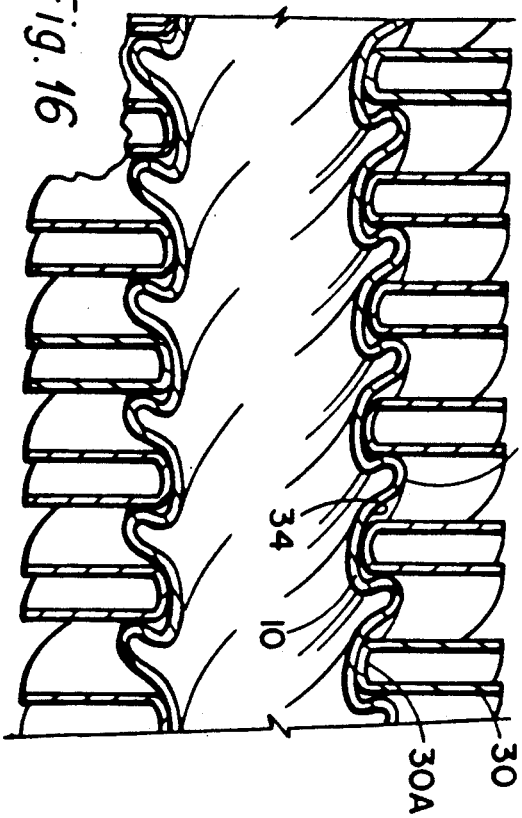
FIG. 16 is a cross-sectional view of a twisted heat exchange tube having U-shaped fins secured to the external surface in the valley in each of the helixes.
Figure 17:
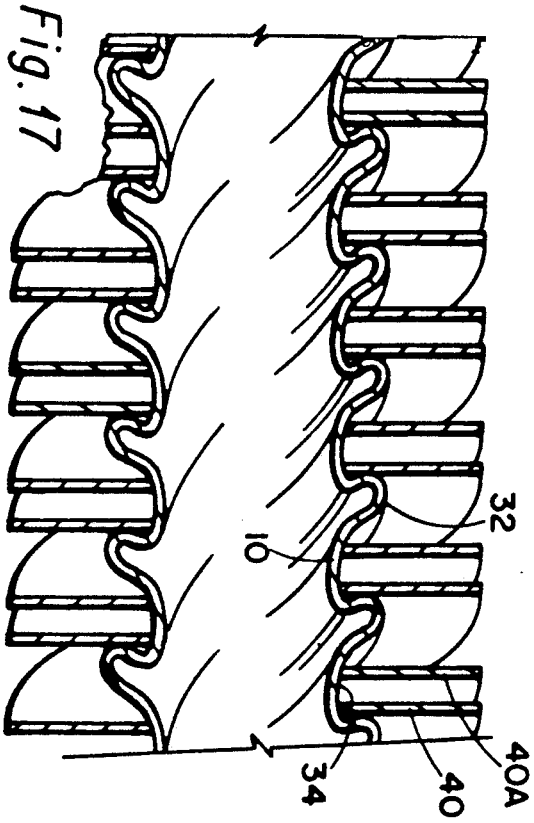
FIG. 17 is a cross-sectional view of a finned tube of the twisted type in which paralleled radially extending fins are positioned in the helical recesses formed on the exterior of the tube.
Figure 15:
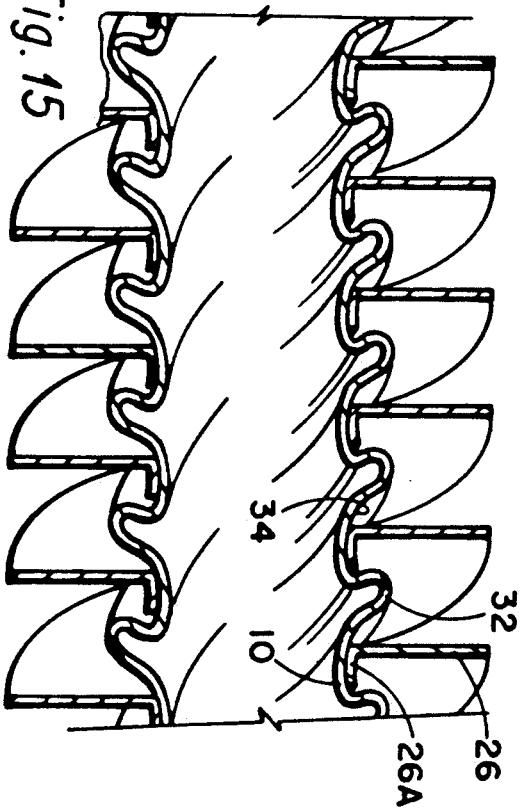
FIG. 15 is a cross-sectional view of a finned tube of the twisted type having a L-shaped external fin secured to the exterior surface of the tube.
Figure 18:
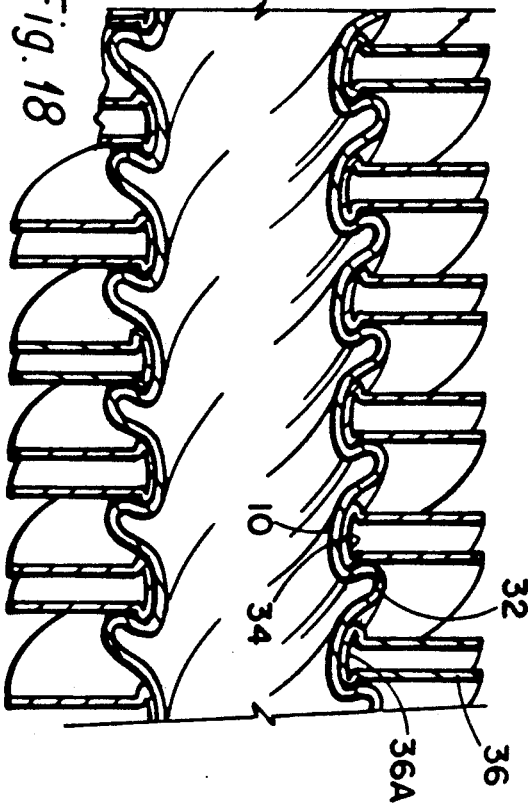
FIG. 18 is a cross-sectional view of a twisted fin tube having a modified type of the U-shaped fin received in each helix and in which the fin is compressed wherein the bite or U-portion of the fin is broadened to provide a wider area of contact with the external surface of the tube.

FIGS. 15-18 show cross-section views of helically twisted tubes with external fins formed in the helical valleys. FIG. 15 shows an L-shaped fin, as in FIG. 10, with the same number of fins being employed as the number of convolutes. FIG. 16 shows the use of U-shaped fins, as in FIG. 8, but in the arrangement wherein the tube has been twisted in a manner to form different shaped integral convolutes in the tube wall which increases the internal turbulence of the fluid flow. FIG. 17 shows the employment of parallel fins 40 and 40A in each of the helical valleys 34 in the tube wall 10, there being the same number of sets of fins as the number of integral convolutes. FIG. 18 shows the arrangement utilizing U-shaped fins 36 with a broadened base 36A, as described with reference to FIG. 9, but with a convoluted tube which has been twisted in a manner to cause the integral convolutes 32 to somewhat overlap the helical valleys 34. FIGS. 15–18 are illustrated to show that various fin arrangements may be utilized with helical twisted heat exchanger tubes.

Figure 19:
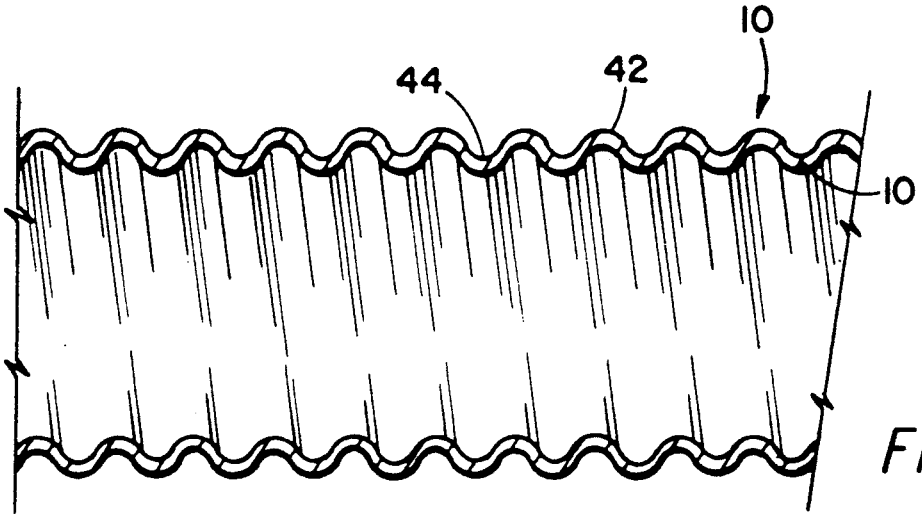
FIG. 19 is a cross-sectional view of the tube which has been rolled to form a thread design in the tube wall. The rolling is accomplished by turning the tube relative to a rotating die to form one or more helixes therein. The rolled configuration of FIG. 12 is achieved in a manner completely dissimilar to that of convoluting a tube by twisting.
Figure 20:
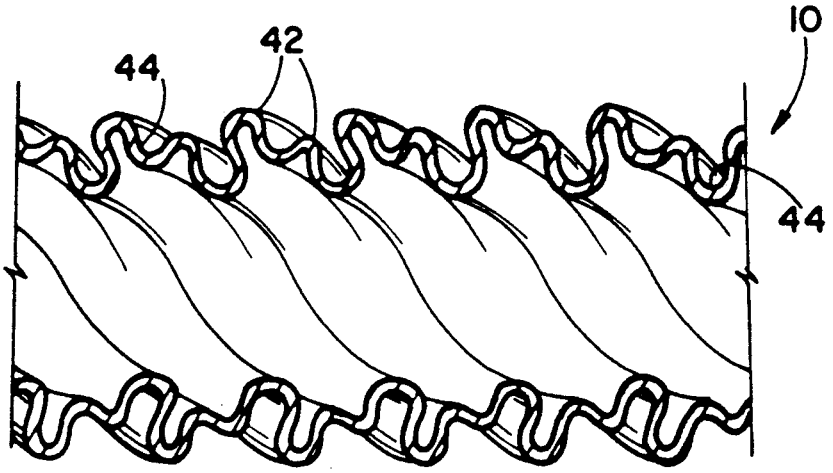
FIG. 20 is a cross-sectional view of a fin tube of the type shown in FIG. 19 after the tube has been convoluted by twisting the tube. Such twisting accomplishes a significant increase in the internal and external surface area per length of the tube to enhance heat transfer between fluid in the tube and fluid externally of the tube.

FIGS. 19 and 20 show a different embodiment of the invention. FIG. 19 is a cross-section of a heat exchange tube generally indicated by the numeral 10 in which the tube wall 10 has been rolled such as by turning the tube against a rotating die (not shown) to form an integrally rolled threaded configuration in the tube wall. This rolled thread is helical and is formed in the tube without twisting the tube, the rolled thread distorts the tube wall 10 providing alternate peaks 42 and valleys 44. Rolling the tube to provide the configuration of FIG. 19 increases the internal and external cross-sectional area of the tube exposed to a fluid medium for heat transfer for a given length of tube. In addition, the rolled thread distortion of the tube wall causes increased turbulence of fluid flow through the interior of the tube. The tube of FIG. 19 is of a type known in the prior art.

FIG. 20 is a cross-sectional view of a tube 10, as in FIG. 19 which has been rolled against a rotating die to form an integrally threaded configuration therein; and, thereafter, has been twisted to form integral convolutes. It can be seen that the combination of these two steps provides a heat exchange tube having a complex wall configuration providing greatly increased cross-sectional area per given length internally and externally of the tube and wherein turbulence of fluid flow through the tube is substantially increased. The exact configuration of the wall achieved by the process exemplified in FIG. 20 will depend upon a number of factors, such as the pitch of the rolled thread formed in the tube wall, as in FIG. 19, and the number of paralleled convolutes formed as the tube is twisted.

Figure 21:
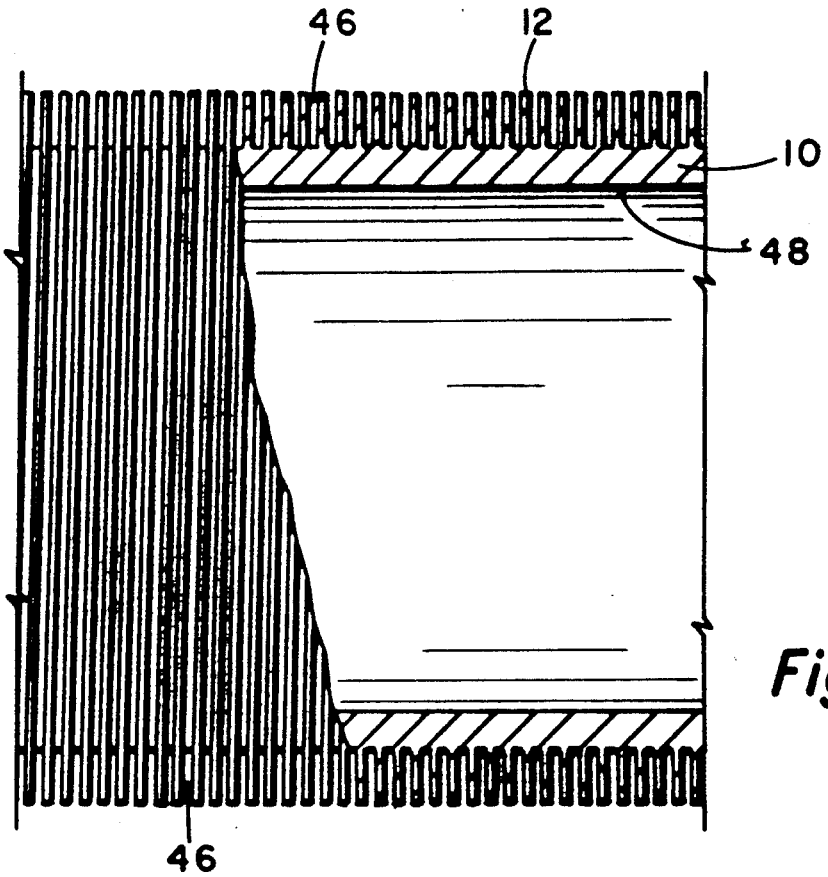
FIG. 21 is an external view of a short length of tube, shown partially in cross-section, into which a spiral groove has been cut into the external surface. The internal surface of the tube remains substantially cylindrical about a straight axis. The groove cut in the tube can be cut such as on a lathe, that is, by rotating the tube against a cutting tool.
Figure 22:
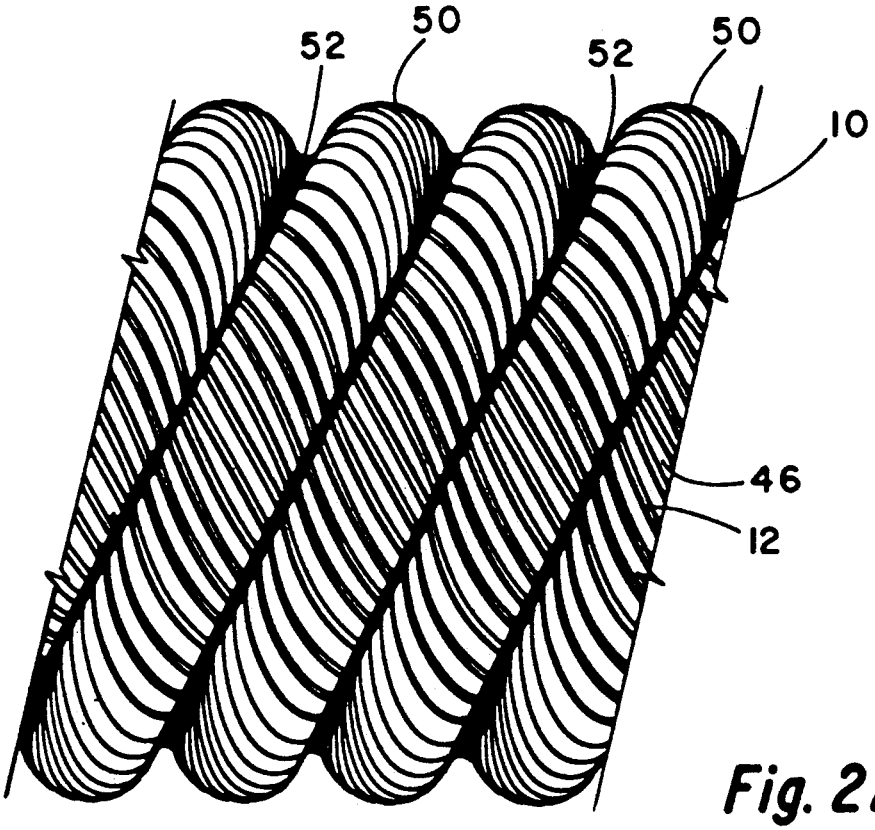
FIG. 22 is an external view of the tube of the type shown in FIG. 21 after the tube has been twisted to form convolutes therein.

FIGS. 21 and 22 show an alternate arrangement of the concept generally described with reference to FIGS. 19 and 20. FIG. 21 shows a tube in which a spiral groove 46 has been cut into the exterior cylindrical surface 12 of the tube wall 10. The groove 46 can be cut in the tube wall exterior surface such as by rotating the tube on a lathe and cutting groove 46 by a stationary machine tool cutter. Note that the tube internal cylindrical wall 48 remains cylindrical or, at least substantially cylindrical, and the imaginary axis (to shown) of the tubular internal wall 48 remains substantially straight. The groove 46 shown in FIG. 6 is relatively deep, that is, over half of the thickness of the tube wall 10 and it can be seen that the depth of the groove 46 is selectable and may be relatively shallow compared to the tube wall thickness or relatively deep, as shown. In addition, the groove 46 formed in wall 10 of FIG. 1 is very closely spaced together and, obviously, the spacing of the groove can vary considerably.

Cutting groove 46 in the external wall of the tube 10 of FIG. 21 substantially increases the external surface area which greatly enhances the heat exchange capability of the tube compared to that of the cylindrical tube before the groove 46 is cut therein. The remaining wall of the tube between adjacent grooves 46 forms, in effect, integral fins.

The groove 46 could be cut cylindrically around the exterior of the tube, that is, where the tube external surface 12 has formed therein a series of spaced apart cylindrical grooves; however, this procedure is mechanically more time consuming and difficult to achieve than the steps required to form a spiralled groove 46. Since a spiralled groove is easier to mechanically accomplish and has all of the advantages of increasing the tube external surface area, there is no advantage or incentive to form the groove 46 as a sequence of closely spaced concentric grooves in the tube wall.

In order to further increase the effectiveness of heat transfer of the tube of FIG. 21, according to the principles of this invention, the tube, after the groove 46 is formed therein, is twisted and after twisting, will have an external appearance such as that shown in FIG. 22. The grooves 46 in the tube wall 12 remain, but the grooves are superimposed on the convolutes 50 formed in the tube of FIG. 21, the convolutes 50 being separated by valleys 52. The step of twisting the tube to form convolutes 50 and valleys 52 can be practiced, as previously described, wherein only a single spiral convolute is formed or in which a plurality of paralleled spiral convolutes are formed. From the appearance of the external tube after it is formed, it is difficult to distinguish the number of spiral convolutes. For instance, in FIG. 22, the drawing was made based upon a twisted tube having grooves cut therein, as in FIG. 21 in which there were four paralleled convolutes 50 formed in the tube.

The twisted tube of FIG. 22 has the advantages as set forth in the other embodiments previously described in that, not only is the external surface area of the tube dramatically increased by the employment of fins, whether the fins are attached as in the previous embodiment or integral fins as in FIGS. 21 and 22. Further, the heat transfer efficiency of the tube is greatly increased by the non-cylindrical interior surface of the tube achieved by twisting. This non-cylindrical interior surface greatly increases the turbidity of fluid flow through the tube thereby eliminating the likelihood of laminar flow.

Figure 23:
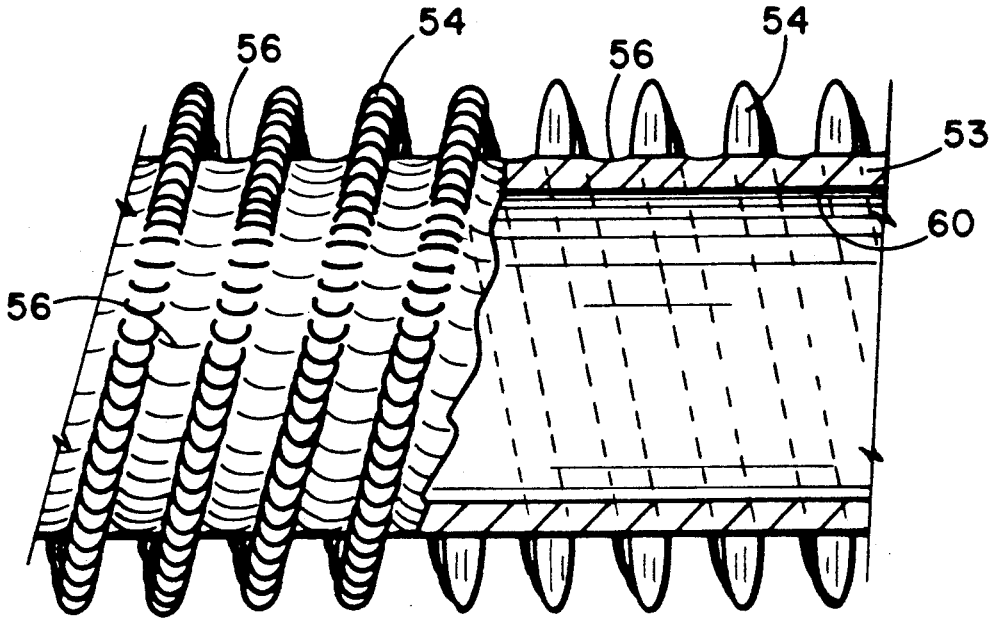
FIG. 23 is an external view of a short length of tube, shown partially in cross-section, having integral, upstanding spines formed in the exterior cylindrical surface. The internal surface remains substantially cylindrical about a straight axis.
Figure 24:
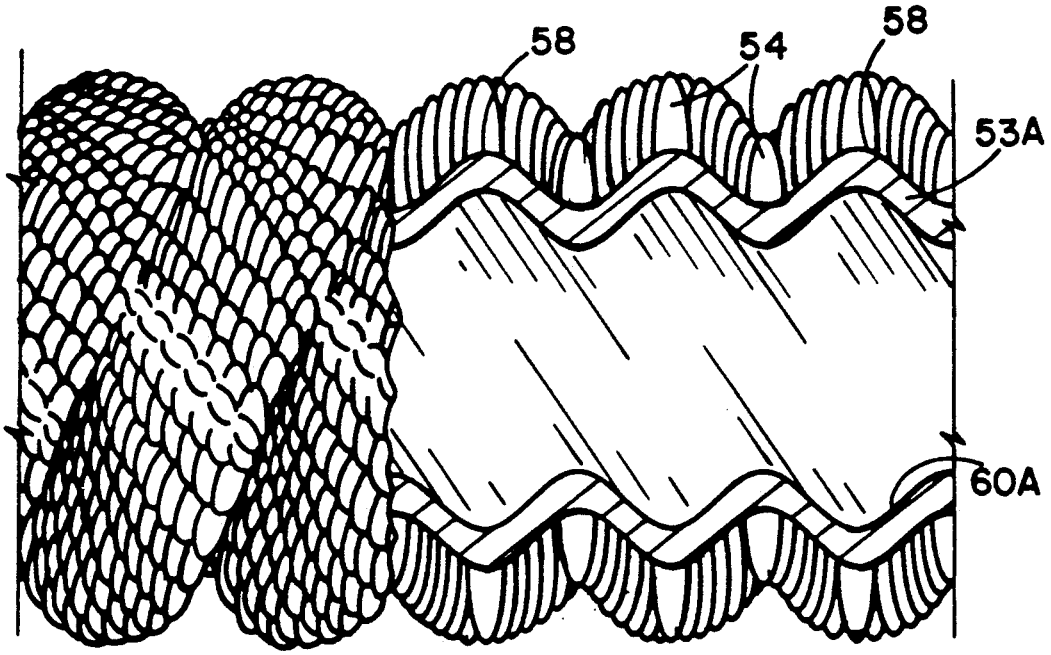
FIG. 24 is an external view of a tube of the type shown in FIG. 23, shown partially in cross-section, after the tube has been twisted to form convolutes therein.

In the embodiment of FIGS. 23 and 24, tube 53 has formed in the external cylindrical surface integral, upstanding spines 54. The spines are typically formed by sequentially gouging each spine from the tube exterior surface, leaving a cupped out area 56 as each spine is formed. The spines 54 are typically formed, as illustrated, in a spiral pattern and the spiral rows of spines may be spaced apart as shown in FIG. 23, or more closely spaced. Spiney finned heat exchange tubes as shown in FIG. 23 have been used in heat exchange applications, and the treatment of a cylindrical tube to add the spines 54 greatly increases the external surface area of the tube per unit of length, but the internal surface 60 remains cylindrical, thus permitting laminar fluid flow.

FIG. 24 shows the tube 53 of FIG. 23 having been twisted to form integral convolutes 58 in the tube wall 53A. This technique achieves two significant results. First, the external surface area per unit of length is significantly increased. Second, the convoluted internal surface 60A breaks up the patterns of fluid flow through the interior of the tube, thus, achieving improved transfer of heat between fluids interior of and exterior of the tube.

As stated earlier, the present disclosure contemplates two basic embodiments of the method of manufacturing and improved heat exchange tube. In the first embodiment, a tube which has been twisted is equipped with an external fin. In the other basic embodiment, a tube is first equipped with an external fin and is then twisted. Either method results in a heat exchange tube having improved heat transfer characteristics.

The techniques of this invention provide highly improved heat transfer characteristics for finned tubes which may be used in a great number of different applications.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of manufacturing a heat exchanger tube starting with an elongated cylindrical tube having a wall with substantially cylindrical external and internal surfaces, comprising the steps of:

cutting an elongated groove circumferentially about the tube throughout a substantial portion of the full length thereof in the external cylindrical surface of the tube wall to form an integral external finned tube; and twisting the integral external finned tube to form spiralled convolutes in the tube wall external and internal surfaces.

2. A method of manufacturing a heat exchanger tube starting with an elongated cylindrical tube having a wall with substantially cylindrical external and internal surfaces, comprising the steps of:

gouging closely spaced integral upstanding spines in the tube external cylindrical surface to form a spiny surfaced tube throughout a substantial portion of the full length thereof; and twisting the spiny surfaced tube to form spiraled convolutes in the tube wall cylindrical external and internal surfaces.

3. A method of manufacturing a heat exchanger tube having a tube wall with an external surface, comprising the steps of:

twisting an elongated cylindrical tube to form at least one convoluted spiralled recess in the tube wall throughout a substantial portion of the full length thereof; and affixing an elongated upstanding fin to the tube wall external surface in at least one spiral recess therein throughout said substantial portion of the full length of the tube.

4. A method of manufacturing a heat exchanger tube starting with an elongated tube having a wall with substantially cylindrical external and internal surfaces, comprising the steps of:

affixing an elongated fin member to the cylindrical exterior surface of the tube throughout a substantial portion of the full length thereof to form a finned tube; and twisting the finned tube to form at least one integral spiralled convolute in the tube wall external and internal surfaces, the formed spiralled tube having the fin member extending from the exterior surface thereof throughout said substantial portion of the full length thereof.

5. The method of claim 4 wherein the pitch of the integral spiralled convolute formed in the tube wall is substantially equal in pitch to the spiralled pattern of the fin member affixed to the tube external surface.

6. A method of manufacturing a heat exchanger tube starting with an elongated tube having a cylindrical wall, comprising the steps of:

forming the cylinder walled tube with integral rolled threads throughout a substantial portion of the full length thereof; and twisting the formed tube having integrally rolled threads to form a tube having one or more spiralled convolutes in the tube wall, the spiralled convolutes having said integrally rolled threads superimposed thereon.

* * * * *